US005353493A

United States Patent [19]

Harada et al.

[11] Patent Number: 5,353,493

[45] Date of Patent: Oct. 11, 1994

[54] METHOD FOR MANUFACTURING WHIP ANTENNA

[75] Inventors: Jiro Harada, Tokyo; Heizo Tsuchida, Kanagawa, both of Japan

[73] Assignee: Harada Kogyo Kabushiki Kaishi, Tokyo, Japan

[21] Appl. No.: 898,187

[22] Filed: Jun. 12, 1992

Related U.S. Application Data

[62] Division of Ser. No. 504,236, Apr. 4, 1990, abandoned.

[51] Int. Cl.[5] ..... H01P 11/00

[52] U.S. Cl. ..... 29/600; 72/76; 343/715; 343/899; 343/900

[58] Field of Search ..... 343/715, 900, 901, 899; 29/600; 72/76, 402

[56] References Cited

U.S. PATENT DOCUMENTS

| | | | |
|---|---|---|---|
| 1,507,585 | 9/1924 | Cook | 72/76 |
| 2,206,821 | 7/1940 | Mydlil | 343/715 |
| 2,373,660 | 4/1945 | Glosson | 343/900 |
| 2,396,121 | 3/1946 | Patino | 343/901 |
| 3,229,296 | 1/1966 | Saari | 343/900 |
| 3,303,681 | 2/1967 | LeFiell | 72/76 |
| 4,058,811 | 11/1977 | Gauss et al. | 343/715 |

FOREIGN PATENT DOCUMENTS

| | | | |
|---|---|---|---|
| 2357542 | 5/1975 | Fed. Rep. of Germany | 343/715 |
| 1087641 | 2/1955 | France | 343/899 |
| 59-174242 | 10/1984 | Japan | 72/76 |
| 1008492 | 10/1965 | United Kingdom | 343/715 |
| 1538748 | 1/1979 | United Kingdom | 343/715 |
| 2035699 | 6/1980 | United Kingdom | 343/715 |

OTHER PUBLICATIONS

Allen, J. W. Mechanical Design Analysis For Whip--Type Antennae Tid-4500 (15th Ed.) Instruments, Case #867.52, Mar. 1961, 18 p053534590 ages.

*Primary Examiner*—Carl J. Arbes

*Attorney, Agent, or Firm*—Koda and Androlia

[57] ABSTRACT

A whip antenna made of a material having high tensile strength, such as stainless steel, including a tapered antenna body and a rounded end, both formed as a single integral unit. The antenna is formed by beating a rod having high tensile strength towards its center and pulling the rod in one direction to form the rod into a tapered shape and forming a rounded top section at the tapered end.

4 Claims, 2 Drawing Sheets

METHOD FOR MANUFACTURING WHIP ANTENNA

This is a division of U.S. application Ser. No. 504,236, filed Apr. 4, 1989, now abandoned.

BACKGROUND OF THE INVENTION

1. Field of the Invention

The present invention relates to a whip antenna and a method for manufacturing the same.

2. Prior Art

Various types of antennas are used as automobile radio receivers. Among them, single-length whip antennas can be manufactured at low cost while still maintaining the necessary reception standard.

The receiving section of the single-length whip antenna is made of a single conductive rod which is matched to a quarter wavelength of the FM band. Once such an antenna is mounted on a vehicle, it is exposed outside of the vehicle. Accordingly, a material having high tensile strength and high recovery properties (e.g., high tensile strength stainless steel) is used so that the whip antenna can withstand loads applied by obstacles during the operation of the vehicle and when the vehicle is driven into a car wash, garage, etc.

Some antennas of this type are tapered to increase the recovery property, that is the antenna's ability to return to its original state after being bent by loads.

One example of such a taper-shaped antenna is described in the Japanese Utility Model Application Publication (Kokoku) No. 51-11305. This antenna utilizes a multiple number of stepped elements formed by stamp forging, and a rounded top element is attached to the tip of the antenna. In other words, the top element is manufactured separately from the antenna and then attached to the tip end of the antenna by press fitting, etc. Thus, extra processing steps are required in the manufacture of tapered antennas, and a high precision work is required to form the tip end of the antenna so that the top element attaches easily and securely.

SUMMARY OF THE INVENTION

Accordingly, it is an object of the present invention to provide a whip antenna for which there is no separate manufacturing process for the top element, thus eliminating the work required to attach the top element to the tip of the tapered portion of an antenna.

The whip antenna of the present invention includes a tapered antenna body having a small diameter (or small-radius) tip end and a rounded top section which is formed as a single, integral unit with the antenna body using a material which has high tensile strength.

The present invention also provides a method to manufacture the above-described antenna in which (a) a rod-form high tensile strength material is shaped into a continuous taper by a method known as "swaging" with one end of the rod left unworked while the rod is pulled in its axial direction in order to improve the tensile strength and the recovery properties of the material with respect to bending loads or moment, and (b) the unworked end is rounded by header working, thus forming a top section which has the same function as a conventional top element.

In the present invention, since the tapered antenna body and the rounded top section, which is located at the small-diameter (or small-radius) end of the tapered antenna body, are formed from a material having high tensile strength as a single, integral unit, there is no need to manufacture the top section separately, and thus the work required to attach the top section to the antenna is eliminated. There is also no need to increase the work precision at the tip end of the tapered portion so as to securely attach the top section.

DETAILED DESCRIPTION OF THE INVENTION

Figure 1A:
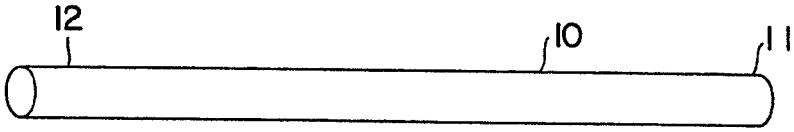
FIGS. 1(*a*) through 1(*e*) are explanatory diagrams illustrating the manufacturing step of the antenna of the present invention.
Figure 1B:
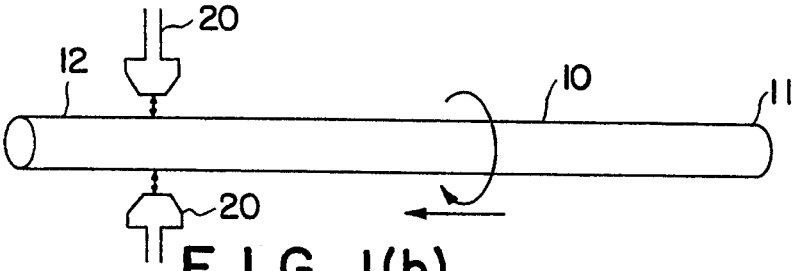
Figure 1C:
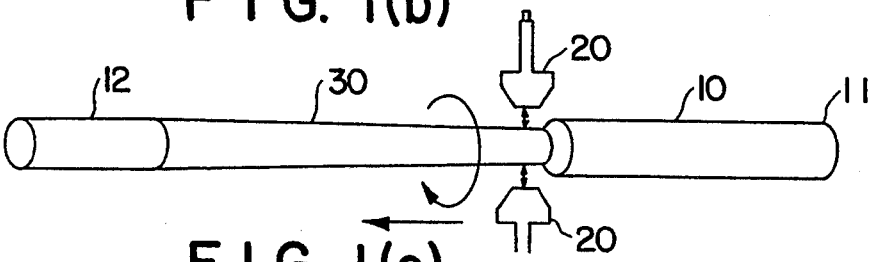
Figure 1D:
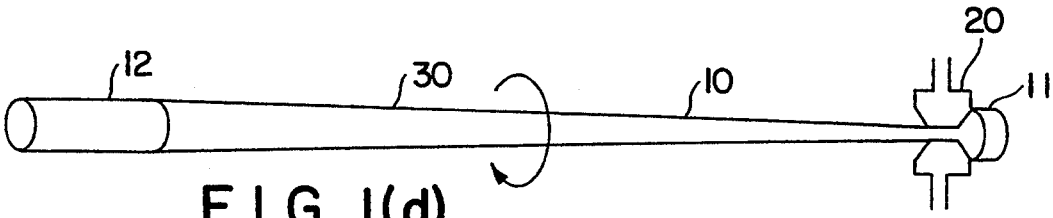
Figure 1E:
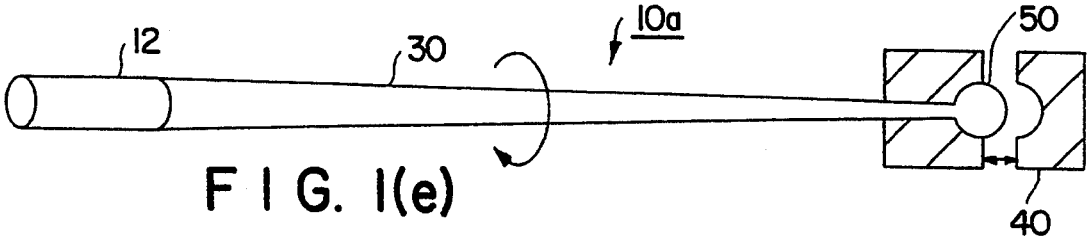

In the manufacturing process of the antenna of the present invention, a rod made of, for example, stainless steel having high tensile strength is first shaped into a taper by stamping it in the radial direction while the rod is pulled in the axial direction with one end of the rod left unworked. The unworked end of the rod is rounded by header working.

In the drawing, particularly in FIG. 1(*a*), the right end of a rod 10 (which is made up of stainless steel, etc. having a high tensile strength) is the "tip end" 11, and the left end of the rod 10 is the "base end" 12.

As shown in FIG. 1(*b*), a type of metal working called "swaging" is started near the base end 12 of the rod 10 using heads 20.

The rod 10 is moved or pulled in the direction shown by the straight arrow while being rotated at a predetermined speed in the direction indicated by the circular arrow. While the rod 10 is thus moved in the direction of its own axis, a plurality of (two in the drawing) fixed-heads 20 are moved to and away from the rod 10 with respect to the axis of the rod while being rotated about the axis of the rod 10 at a prescribed speed so that the rod 10 is beaten by the heads 20.

As seen from FIG. 1(*c*), a tapered portion 30 is gradually formed by shortening the distance between the points struck or beaten by the heads 20 as the rod 10 is moved toward the left in the Figure (with respect to the rotating heads 20). Swaging is completed with an unworked portion left at the tip end 11 of the rod 10 (FIG. 1(*d*)).

As a result of the swaging, the tensile strength of the rod (at the portion where the swaging was worked) increases compared to the tensile strength of the rod before swaging. In addition, the tensile strength and elasticity increase as the surface reduction rate increases, in other words, as the rod 10 becomes more slender. However, the low hardness and low tensile strength of the unworked portion of the rod 10 at the tip end 11 remains.

Next, the unworked portion at the tip end of the rod 10, which has good workability, is formed into a prescribed rounded shape by a pressing method using a header 40 as shown in FIG. 1(*e*), so that a top section 50 is formed. When the header working is finished, manufacture of the whip antenna rod 10*a* is completed.

Thus, the tapered antenna body (corresponding to the tapered portion 30) and the rounded top section 50, which is located at the small-diameter (or small-radius) end of the tapered antenna body, are formed in a single, integral unit from a material having high tensile strength.

In the embodiment, the rod 10 is worked into a taper by beating (or compressing) it in the radial direction (or towards the central axis of the rod) while the rod is pulled in one direction along its own axis. Accordingly, there is no waste of the material, and an antenna is obtained using a rod which is shorter than the finished antenna. The surface texture of the finished antenna is improved, and the strength of the antenna can be increased so that the antenna can resist even a great deal of bending force.

Furthermore, in the embodiment, the tip end 11 of the rod 10 left unworked (during the taper working) is rounded by header working. Thus, there is no need to manufacture the top element separately, and the work required to attach such a top element to the tip of the tapered portion is eliminated. Also, it is not necessary to increase the working precision of the tip of the tapered portion.

Figure 2:
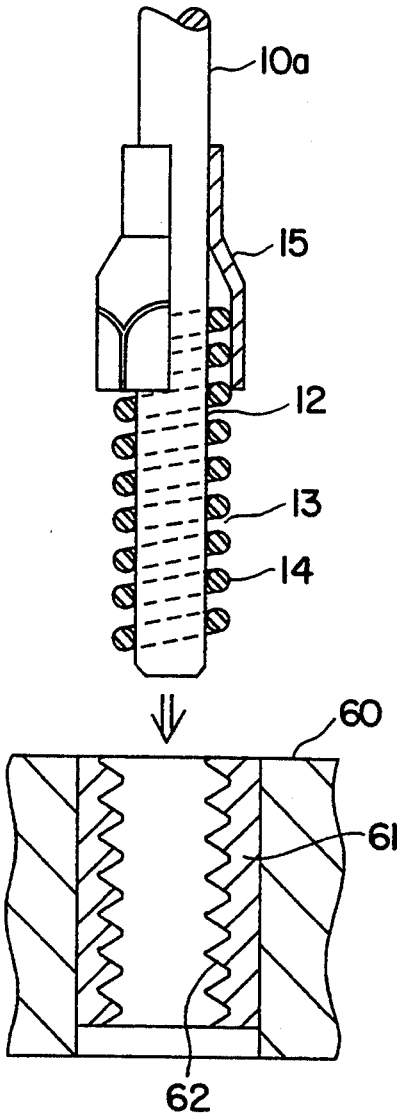
FIG. 2 illustrates an example in which the base of the antenna of present invention is mounted to an attachment base.

FIG. 2 illustrates an example in which the antenna (having the base end 12 on the rod 10) obtained pursuant to the above-described embodiment is mounted to an attachment base.

A helical element 14 is fastened to the base end 12 of the whip antenna 10*a* (via welding) so that the helical element 14 functions as a male screw 13. A screwing cap 15 is attached to the antenna 10 so that the cap 15 covers the uppermost portion of the screw 13. A coupling assembly 61 with a female screw 62 therein is fastened to an attachment base 60.

With such an arrangement and use of a material having high tensile strength, the high tensile strength of the material can be utilized "as is" in the area where the antenna rod is coupled to the attachment base. Thus, the strength of the coupling portion is sufficiently strong.

The male screw 13 can be formed by thread rolling. In addition, a high tensile strength material other than stainless steel may be used for the rod 10.

As described in detail in the above, according to the present invention, there is no need to manufacture a top element separately; thus, eliminating the work necessary to attach the top element to the tip of the tapered portion of the antenna. In addition, there is no need to increase the working precision at the tip end of the tapered portion required to attach the top element to the antenna.

Furthermore, since the rod is worked into a continuous taper by swaging, a rod with a reduced-diameter is stretched length wise. Thus, an antenna rod of a prescribed length can be manufactured using a rod shaped material which is shorter than the length of the resultant antenna, thereby making the manufacturing process of the antenna economical.

We claim:

1. A method for manufacturing a whip antenna characterized in that said method comprises the steps of:

working a rod-form material having high tensile strength into a continuous taper shape by swaging, with one end thereof left unworked, while said rod-form material is pulled in one direction along its own axis, a resultant continuous tapered rod being longer and higher in tensile strength than said rod-form material; and forming an antenna top section from said unworked portion of said rod-form material by header working.

2. A method for manufacturing a whip antenna comprising the steps of:

beating the outer surface of one end of a rod-form material with a plurality of beating heads advancing toward an axis of said rod-form material while said rod is rotated about its axis;

pulling said rod in one direction so that said rod being beaten by said beating heads is reduced in diameter toward the other end thereof so that said rod is formed into a tapered rod, whereby said resultant tapered rod is longer in length and higher in tensile strength than said rod; and forming said other end into a rounded shape.

3. A method for manufacturing a whip antenna according to claim 2, wherein said rod-form material has high tensile strength.

4. A method for manufacturing a whip antenna according to claim 2, wherein said rod-form material is stainless steel.

* * * * *